US011530084B1

(12) United States Patent
Brand

(10) Patent No.: US 11,530,084 B1
(45) Date of Patent: Dec. 20, 2022

(54) PRODUCT INSERT AND SHIPPER

(71) Applicant: Packaging Corporation of America, Lake Forest, IL (US)

(72) Inventor: Rebecca A. Brand, Palos Verdes Estates, CA (US)

(73) Assignee: Packaging Corporation of America, Lake Forest, IL (US)

( * ) Notice: Subject to any disclaimer, the term of this patent is extended or adjusted under 35 U.S.C. 154(b) by 46 days.

(21) Appl. No.: 17/146,337

(22) Filed: Jan. 11, 2021

Related U.S. Application Data

(60) Provisional application No. 62/960,642, filed on Jan. 13, 2020.

(51) Int. Cl.
*B65D 81/02* (2006.01)
*B65D 5/50* (2006.01)

(52) U.S. Cl.
CPC ..... *B65D 81/025* (2013.01); *B65D 5/5035* (2013.01)

(58) Field of Classification Search
CPC .. B65D 81/025; B65D 5/5035; B65D 77/042; B65D 81/05; B65D 5/4266; B65D 81/107; B65D 81/113
USPC ..... 206/583, 592, 166, 170, 521, 597, 395, 206/594
See application file for complete search history.

(56) References Cited

U.S. PATENT DOCUMENTS 1,900,820 A * 3/1933 Kenyon ..... B65D 5/5035 206/576
2,744,622 A * 5/1956 Sparks ..... B65D 5/4204 206/521.2
2,827,219 A * 3/1958 Sparks ..... B65D 5/5061 206/592
3,294,226 A * 12/1966 McFarland ..... B65D 85/42 206/418
3,465,877 A * 9/1969 Martin ..... B65D 5/5035 206/433
3,752,301 A * 8/1973 Bluemel ..... B65D 5/5045 206/583
4,027,794 A * 6/1977 Olson ..... B65D 5/5095 206/583
4,117,929 A * 10/1978 VanderMey ..... B65D 5/5035 206/592
4,171,762 A * 10/1979 Matthews ..... B65D 5/48048 229/120.26

(Continued)

*Primary Examiner* — Steven A. Reynolds
*Assistant Examiner* — Prince Pal
(74) *Attorney, Agent, or Firm* — Klarquist Sparkman, LLP

(57) ABSTRACT

An article can include a panel member folded to form a collapsible sleeve comprising a first panel layer and a second panel layer, the panel member movable between a first configuration and a second configuration, the first and second panel layers defining a product-receiving portion. Each of the first panel layer and the second panel layer can comprise a pivotable edge portion and an extension portion coupled to the pivotable edge portion and received in an opening defined in a respective first and second panel layer. The edge portions of the first panel layer and the second panel layer are pivotable together to form a double-layered support member extending at an angle to the product-receiving portion on a first side of the product-receiving portion and the extension portions are pivotable out of their respective openings on an opposite, second side of the product-receiving portion by motion of the pivotable edge portions.

21 Claims, 14 Drawing Sheets

(56) References Cited

U.S. PATENT DOCUMENTS 4,284,195 A * 8/1981 Champlin ..... B65D 71/36 206/427
4,792,043 A * 12/1988 Holladay ..... B65D 85/68 206/349
4,865,200 A * 9/1989 Sullivan ..... B65D 5/5035 206/451
4,955,502 A * 9/1990 Sorci ..... B65D 5/4804 229/120.24
5,056,665 A * 10/1991 Boecker ..... B65D 81/07 206/583
5,226,542 A * 7/1993 Boecker ..... B65D 81/07 206/583
5,263,612 A * 11/1993 Nederveld ..... B65D 5/008 229/113
5,341,934 A * 8/1994 Hsu ..... B65D 81/05 206/521
5,385,232 A * 1/1995 Foos ..... B65D 81/058 206/583
5,893,462 A * 4/1999 Ridgeway ..... B65D 5/5028 206/583
5,894,932 A * 4/1999 Harding ..... B65D 81/075 206/583
5,915,556 A 6/1999 Simpson
5,967,327 A * 10/1999 Jones ..... B65D 81/075 206/466
5,988,389 A * 11/1999 Buscema ..... B65D 5/5035 229/120.37
6,006,917 A * 12/1999 Loeffler ..... A61F 2/0095 206/583
6,148,590 A * 11/2000 Ridgeway ..... B65D 81/075 206/583
6,223,901 B1 5/2001 Lofgren et al.
6,302,274 B1 * 10/2001 Ridgeway ..... B65D 5/5038 206/583
6,467,624 B1 * 10/2002 Lofgren ..... B65D 81/07 206/583
6,685,025 B1 * 2/2004 Kari ..... B65D 5/5069 206/583
7,584,848 B2 * 9/2009 Yoshifusa ..... B65D 81/052 206/592
7,648,031 B2 * 1/2010 Kari ..... B65D 81/05 206/592
8,127,928 B2 3/2012 Stack, Jr. et al.
8,235,216 B2 8/2012 McDonald et al.
8,714,357 B2 * 5/2014 Ridgeway ..... B65D 5/5028 206/583
9,334,092 B2 * 5/2016 Panzica ..... B65B 11/00
9,868,578 B2 * 1/2018 Ridgeway ..... B65B 5/04
9,932,162 B2 4/2018 Stack, Jr.
10,035,638 B1 * 7/2018 LeRoy ..... B65D 81/133
10,633,140 B1 * 4/2020 Vergara ..... B65D 5/4266
10,913,567 B2 * 2/2021 Nelson ..... B65D 5/002
10,947,007 B2 * 3/2021 Cline ..... B65D 5/5028
11,214,424 B2 * 1/2022 Campos ..... B65D 5/448
2002/0104776 A1 * 8/2002 Foster ..... B65D 5/5028 206/583
2004/0084349 A1 * 5/2004 Kari ..... B65D 5/5052 206/583
2004/0129601 A1 * 7/2004 Lofgren ..... B65D 81/075 206/583
2004/0178113 A1 * 9/2004 Lofgren ..... B65D 81/05 206/583
2006/0102515 A1 * 5/2006 McDonald ..... B65D 5/5059 206/583
2006/0110573 A1 * 5/2006 Peng ..... B65D 81/05 428/121
2006/0131207 A1 * 6/2006 Kari ..... B65D 5/5045 206/591
2007/0034547 A1 * 2/2007 Strona ..... B65D 5/5085 206/583
2007/0135283 A1 * 6/2007 Kari ..... B65D 77/042 493/51
2007/0144936 A1 * 6/2007 Stegner ..... B65D 81/113 206/521
2008/0128316 A1 * 6/2008 McDonald ..... B65D 81/022 53/472
2008/0223750 A1 * 9/2008 McDonald ..... B65D 81/02 206/583
2011/0024324 A1 2/2011 Tanner
2011/0240515 A1 * 10/2011 Ridgeway ..... B65D 5/5028 53/472
2012/0085678 A1 * 4/2012 Yoshida ..... B65D 5/509 206/592
2013/0008812 A1 * 1/2013 Swart ..... B65D 5/5035 229/199
2015/0034709 A1 * 2/2015 Spivey, Sr. ..... B65D 5/46192 229/162.1
2016/0052691 A1 * 2/2016 Ridgeway ..... B65D 81/07 206/583
2017/0361986 A1 * 12/2017 Chen ..... B65D 85/00
2018/0072452 A1 * 3/2018 Chambers ..... B65D 5/541
2018/0346237 A1 * 12/2018 Spartis ..... B65D 5/001
2019/0031390 A1 * 1/2019 Hessburg ..... B65D 5/02
2019/0375567 A1 * 12/2019 Zelenak ..... B65D 5/36
2021/0122552 A1 * 4/2021 Campos ..... B65D 77/042
2021/0163202 A1 * 6/2021 Obeyesekere ..... B65B 5/04

* cited by examiner

PRODUCT INSERT AND SHIPPER

CROSS REFERENCE TO RELATED APPLICATION

This application claims the benefit of U.S. Provisional Patent Application No. 62/960,642, filed Jan. 13, 2020, which is incorporated herein by reference in its entirety.

FIELD

The present disclosure pertains to expandable and collapsible inserts defining a pouch configured to receive a product, and which include support members which can be folded into place such that when the insert is disposed inside a shipping container or box, the product is suspended in the pouch within the container by the support members and spaced apart from the container walls.

BACKGROUND

It can be important to protect certain types of products (e.g., fragile items, liquid-filled containers, electronic components, etc.) from high acceleration events such as impacts, drops, etc., and/or compressing events, all of which can occur during shipping. Existing packaging systems for such products can typically include plastic filler materials such as expanded polystyrene "foam peanuts" or "packing peanuts," plastic air bladders such as bubble wrap, and/or trays on which the product is secured by a plastic film such as shrink wrap. Such packaging systems have a number of drawbacks, including the inability to restrain movement of the product within the box. For example, polystyrene peanuts and bubble wrap can shift during handling of the box and shrink wrap films can plastically deform as the product shifts within the box, degrading their ability to hold the product in place. Further, such materials may not be recyclable and/or may be harmful to the environment. Accordingly, a need exists for containers or boxes, or inserts for such containers, that can protect a product during shipping, while also being more environmentally friendly.

SUMMARY

Disclosed herein are examples of articles that can be configured to retain an object within a portion of the article and, when received within a container or box, suspend the object within the container, away from interior sidewalls of the container. For example, the articles disclosed herein can be configured as inserts, configured to be received in a container or box. In some embodiments, the articles disclosed herein can comprise a first panel layer and a second panel layer that form a double-layered panel member when the article is in a planar, first configuration. The article can be configured to move into a functional, second configuration where a product-receiving portion and support members extending outward from the product-receiving portion are formed. The support members can be configured to interface with the interior sidewalls of the container to suspend the product-receiving portion within the container, away from at least a portion of the interior sidewalls.

In one representative embodiment, an article comprises a panel member folded to form a collapsible sleeve comprising a first panel layer and a second panel layer, the panel member being movable between a planar, first configuration and a folded, second configuration, the first and second panel layers defining a product-receiving portion. The first panel layer comprises a pivotable edge portion and an extension portion coupled to the pivotable edge portion and received in an opening defined in the first panel layer. The second panel layer comprises a pivotable edge portion and an extension portion coupled to the pivotable edge portion and received in an opening defined in the second panel layer. The edge portion of the first panel layer and the edge portion of the second panel layer are pivotable together to form a double-layered support member extending outward, at an angle to the product-receiving portion from a first side of the product-receiving portion. The extension portions are pivotable out of their respective openings to extend outward from an opposite, second side of the product-receiving portion by motion of the pivotable edge portions.

In some embodiments, the pivotable edge portions of the first panel layer and the second panel layer are first pivotable edge portions, the extension portions of the first panel layer and the second panel layer are first extension portions, and each of the first and second panel layers comprises a second pivotable edge portion and a second extension portion on the opposite side of the product-receiving portion from respective first pivotable edge portions.

In some embodiments, the panel member is a rectangular panel member comprising two open ends and two closed ends, the first pivotable edge portions of the first and second panel layers are located at a first open end of the two open ends, and the second pivotable edge portions of the first and second panel layers are located at a second open end of the two open ends.

In some embodiments, when the panel member is in the second configuration and the first and second pivotable edge portions are pivoted relative to the product-receiving portion, the two open ends of the panel member are closed such that a volume within the product-receiving portion is enclosed.

In some embodiments, the extension portion of the first panel layer extends a greater distance beyond the product-receiving portion than the extension portion of the second panel member when the extension portions are pivoted out of their openings and the panel member is in the second configuration.

In some embodiments, edges of the panel member are secured together to form the collapsible sleeve.

In some embodiments, the first panel layer and the second panel layer comprise slits such that the first and second panel layers can expand to a convex shape when an object is received between the first and second panel layers, in the product-receiving portion.

In some embodiments, the article comprises a cellulosic fiber-based material.

In some embodiments, the article is plastic-free.

In some embodiments, the angle is between 60 and 100 degrees.

In another representative embodiment, a system comprises: a box including a plurality of internal walls and an article configured to be moved from a planar, first configuration, to a folded, second configuration and arranged within the box in the second configuration such that a product-receiving portion of the article is suspended within and spaced away from at least a portion of the plurality of internal walls. The article comprises: the product-receiving portion formed by main body portions of a first panel layer and a second panel layer of the article and a plurality of support members formed by pivotable edge portions and extension portions of the first panel layer and the second panel layer. The plurality of support members extends outward from the product-receiving portion, where at least a portion of the plurality of support members are configured to contact one or more of the internal walls of the box.

In some embodiments, support members of the plurality of support members extend outward, at an angle, from the product-receiving portion and wherein the angle is between 60 and 100 degrees.

In some embodiments, support members of the plurality of support members extend outward from opposite sides of the product-receiving portion relative to a horizontal plane defined by the product-receiving portion, and from opposite ends of the product-receiving portion relative to a central longitudinal axis of the product-receiving portion.

In some embodiments, the plurality of support members includes: a first support member that is formed by first pivotable edge portions of the first and second panel layers disposed on a first end of the product-receiving portion and a second support member that is formed by first extension portions of the first panel layer and the second panel layer that extend from respective first pivotable edge portions of the first and second panel layers. The first support member and the second support member are disposed on the first end of the product-receiving portion and extend outward, in different directions, from the opposite sides of the product-receiving portion when the article is in the second configuration.

In some embodiments, the plurality of support members includes: a third support member that is formed by second pivotable edge portions of the first and second panel layers disposed on a second end of the product-receiving portion, the second end disposed opposite the first end, relative to the central longitudinal axis; and a fourth support member that is formed by second extension portions of the first panel layer and the second panel layer that extend from respective second pivotable edge portions of the first and second panel layers. The third support member and the fourth support member are disposed on the second end of the product-receiving portion and extend outward, in different directions, from the opposite sides of the product-receiving portion when the article is in the second configuration.

In some embodiments, the first support member and the fourth support member extend outward from a first side of the opposite sides of the product-receiving portion and the second support member and the third support member extend outward from a second side of the opposite sides of the product-receiving portion.

In some embodiments, the product-receiving portion comprises a cavity defined between the first panel layer and the second panel layer, the cavity configured to receive a product therein.

In some embodiments, the main body portions of the first panel layer and the second panel layer comprise a plurality of slits configured to allow the main body portions to expand to a convex shape when the product is received within the cavity.

In another representative embodiment, an article comprises a double-layered panel member comprising a first panel layer and a second panel layer, the panel member being movable between a planar, first configuration and a folded, second configuration, the first and second panel layers defining a product-receiving portion. The first and second panel layers comprise pivotable edge portions and extension portions coupled to the edge portions, the extension portions having free ends, the extension portions extending inwardly toward a center of main body portions of the first and second panel layers from the edge portions when the panel member is in the first configuration. The edge portions and the extension portions of the first and second panel layers are pivotable to form support members extending from opposite, first and second sides of the product-receiving portion when the panel member is in the second configuration.

In some embodiments, the double-layered panel member comprises corrugated board comprising corrugations extending in a first direction and the first panel layer and the second panel layer comprise a plurality of slits extending in a second direction that is perpendicular to the first direction such that the first panel layer and the second panel layer can flex to accommodate an object in the product-receiving portion.

In some embodiments, the first and second panel layers form a cavity of the product-receiving portion that is configured to receive an object, the cavity defined by a space between the first and second panel layers.

The foregoing and other objects, features, and advantages of the disclosed technology will become more apparent from the following detailed description, which proceeds with reference to the accompanying figures.

DETAILED DESCRIPTION

As introduced above, it can be important to protect certain types of products from high acceleration events (e.g., impacts, drops, etc.) and/or compression events (e.g., crushing from applied inward pressure), all of which can occur during shipping. Existing packaging systems for such products typically include plastic filler materials such as expanded polystyrene "foam peanuts" or "packing peanuts," plastic air bladders such as bubble wrap, and/or trays on which the product is secured by plastic film such as shrink wrap. Such packaging systems have a number of drawbacks, including the inability to restrain movement of the product within the box and being harmful to the environment (e.g., non-recyclable and/or non-biodegradable).

The present disclosure pertains to packaging systems including an expandable, double-layered article configured as an insert, sleeve, receptacle, or holder that is configured to receive an object, such as a product to be shipped. The article (e.g., insert) can comprise a first panel layer and a second panel layer which together define a container portion or product-receiving portion. Each of the first panel layer and the second panel layer comprise edge portions that can be folded or pivoted relative to the product-receiving portion to form integral, double-layered support members that extend from the product-receiving portion at an angle. The pivotable edge portions of the first panel layer and the second panel layer can also comprise respective extension portions coupled to the panel layers on the opposite side of the axis or fold line about which the edge portions pivot. The extension portions can be received in corresponding openings or recesses defined in the first and second panel layers. When the pivotable edge portions are pivoted relative to the product-receiving portion, the extension portions can be pivoted out of the openings such that they extend away from the product-receiving portion at an angle, and on the opposite side of the product-receiving portion from the pivotable edge portion to which they are connected. Thus, in certain embodiments, the insert can be folded into an H-shaped (or I-shaped) member with only two folding actions. When inserted into a shipping container or box, the double-layered support members, the extension portions, and the edges of the product-receiving portion can contact the walls of the box to prevent translation of the insert in all three axes, as well as rotation about any axis.

Figure 1:
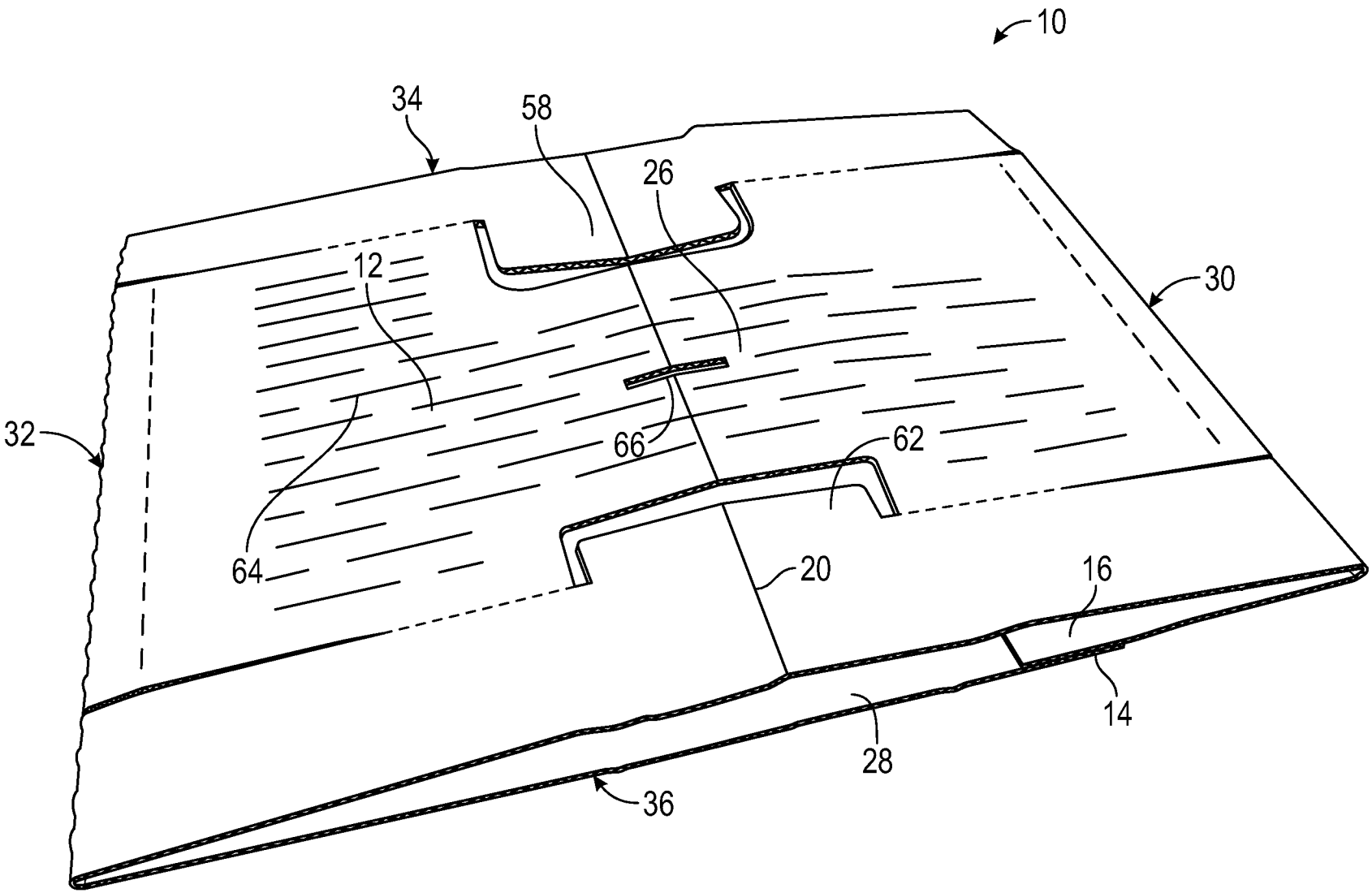
FIG. 1 is a perspective view of an article, configured as an insert for a box, in a planar configuration, the insert configured to receive an object when in an expanded configuration and configured to suspend the object within the box when folded into a folded configuration, according to one embodiment.
Figure 2:
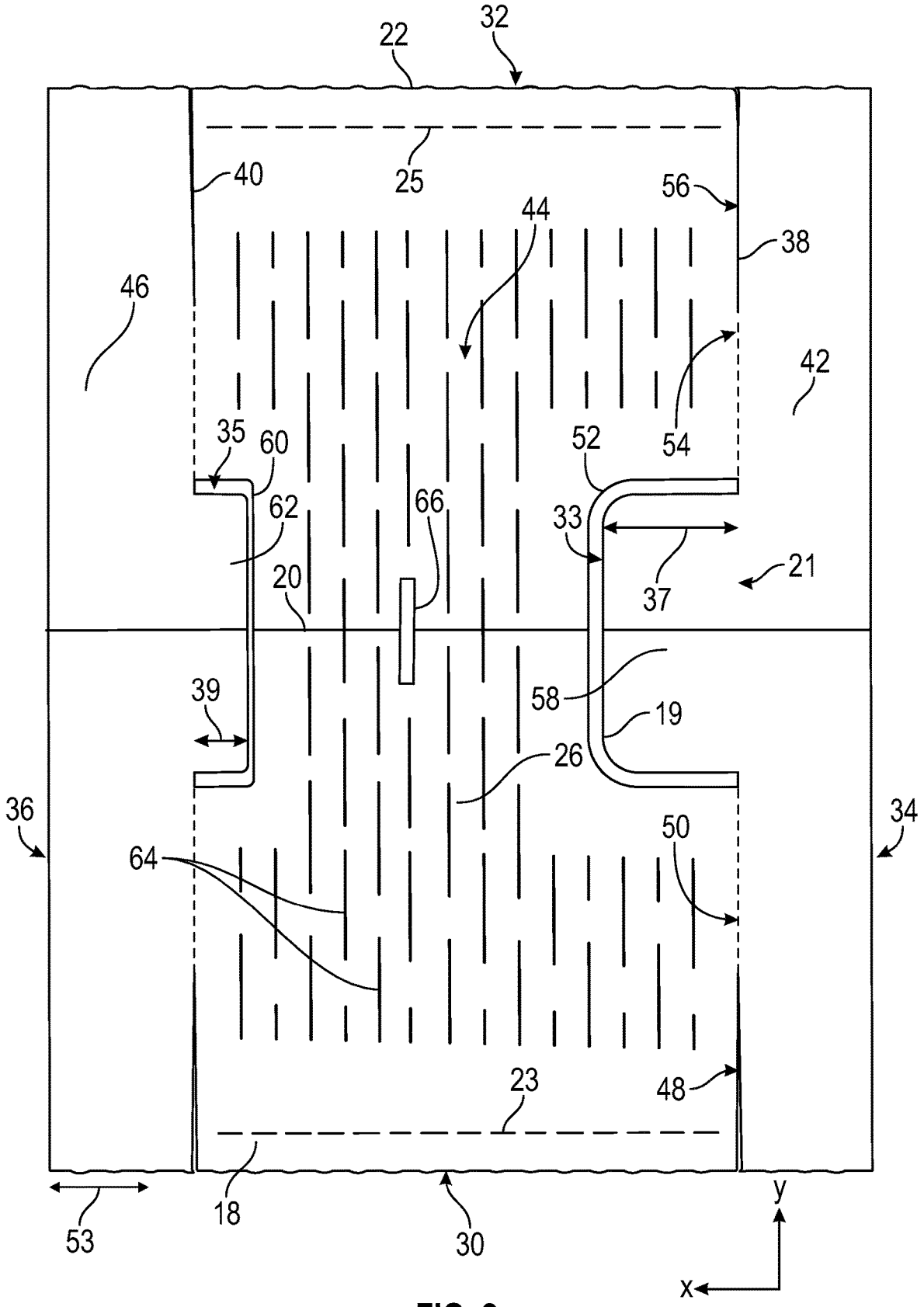
FIG. 2 is a top plan view of a first panel layer of the insert of FIG. 1.
Figure 3:
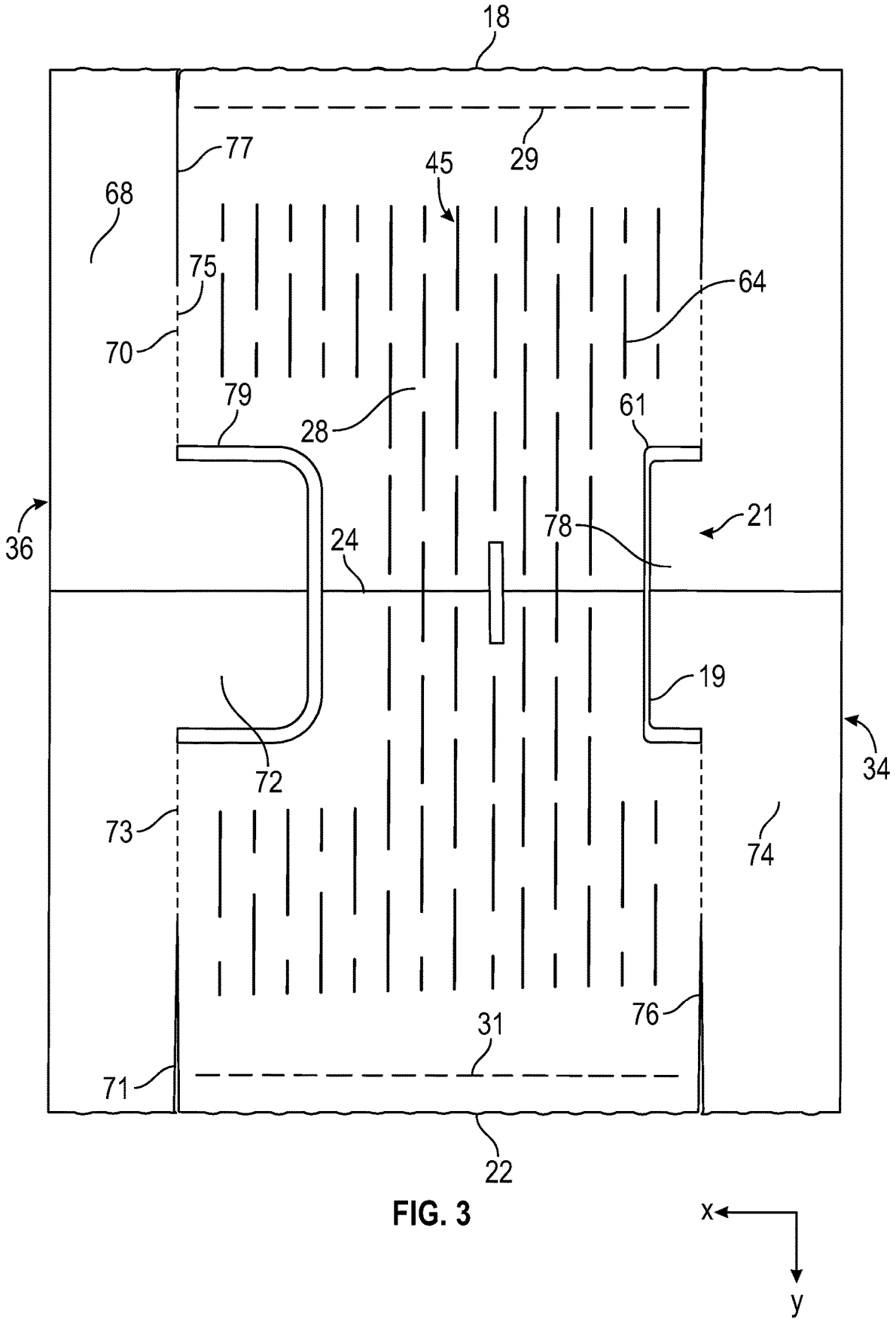
FIG. 3 is a bottom plan view of a second panel layer of the insert of FIG. 1.
Figure 4:
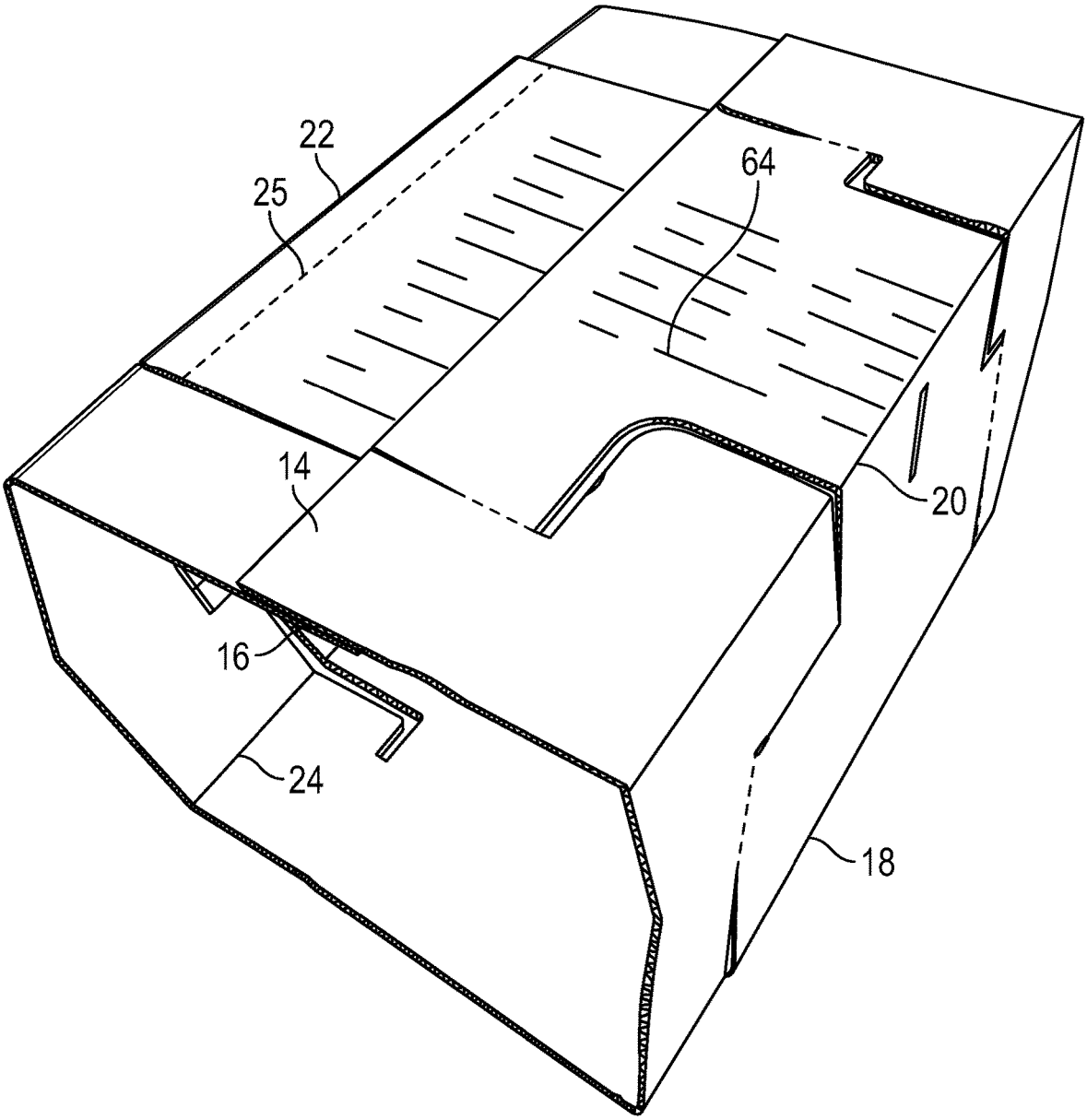
FIG. 4 is a perspective view of the insert of FIG. 1 in the expanded configuration.
Figure 5:
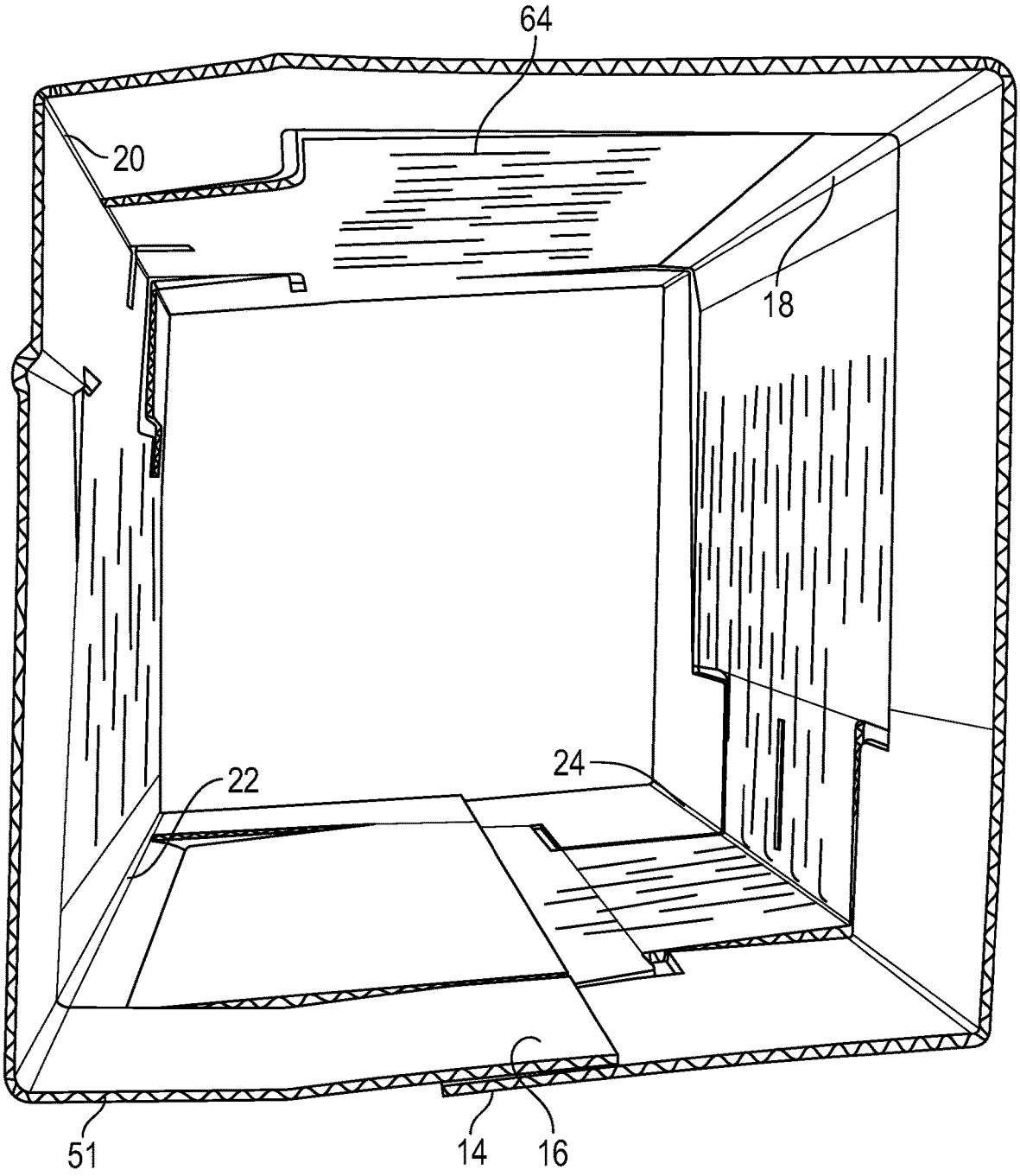
FIG. 5 is an end view of the insert of FIG. 1 in the expanded configuration.

FIGS. 1-8 illustrate an article configured as a product-receiving insert, sleeve, receptacle, or holder 10, according to one embodiment. The insert 10 can comprise a panel member 12 having a first end portion 14 and a second end portion 16. Referring to FIGS. 1, 4, and 5, the first and second end portions 14 and 16 overlap and can be secured together (e.g., using adhesive, fasteners, or other securing means) such that the panel member 12 forms a band or a loop of material. In certain embodiments the first end portion 14 and second end portion 16 can be secured together using a hot-melt adhesive or glue. In this way, edges of the double-layered panel member 12, which may be configured as the first end portion 14 and the second end portion 16, can be secured together to form a collapsible tube or sleeve (e.g., a collapsible rectangular tube or sleeve).

Figure 11:
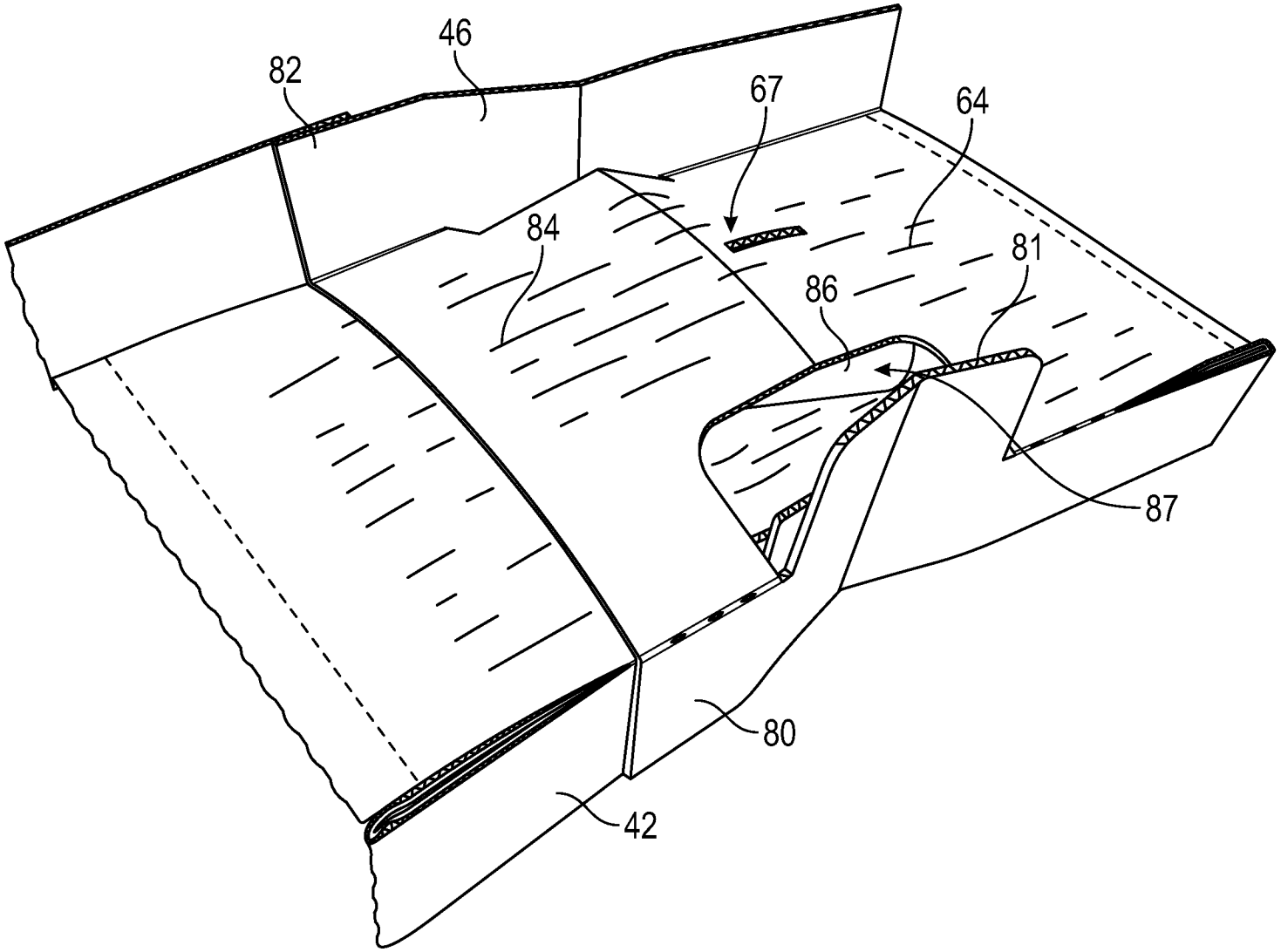
FIG. 11 illustrates folding the insert into the folded configuration.
Figure 12:
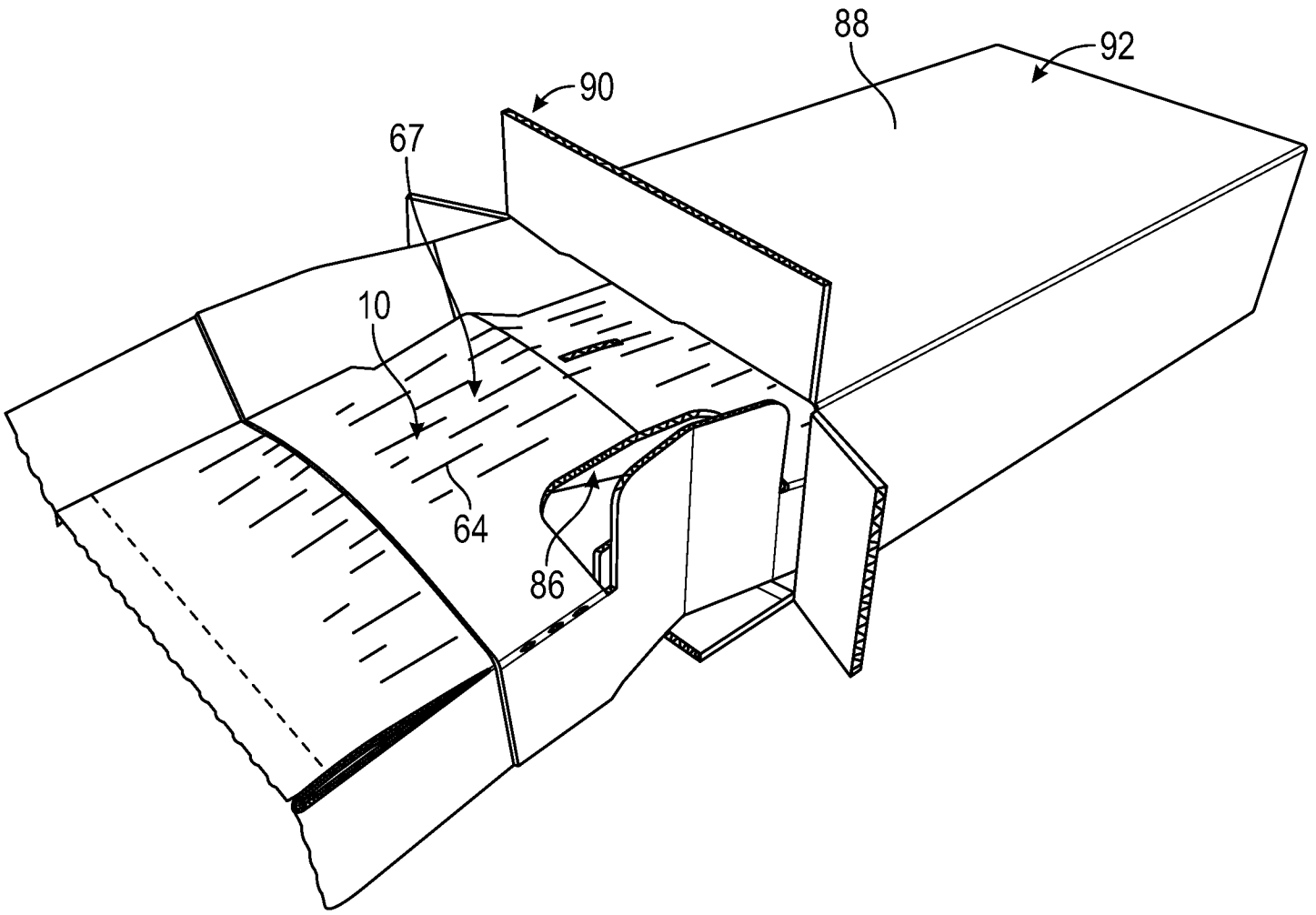
FIG. 12 illustrates placing the insert, in the folded configuration, inside a box.
Figure 13:
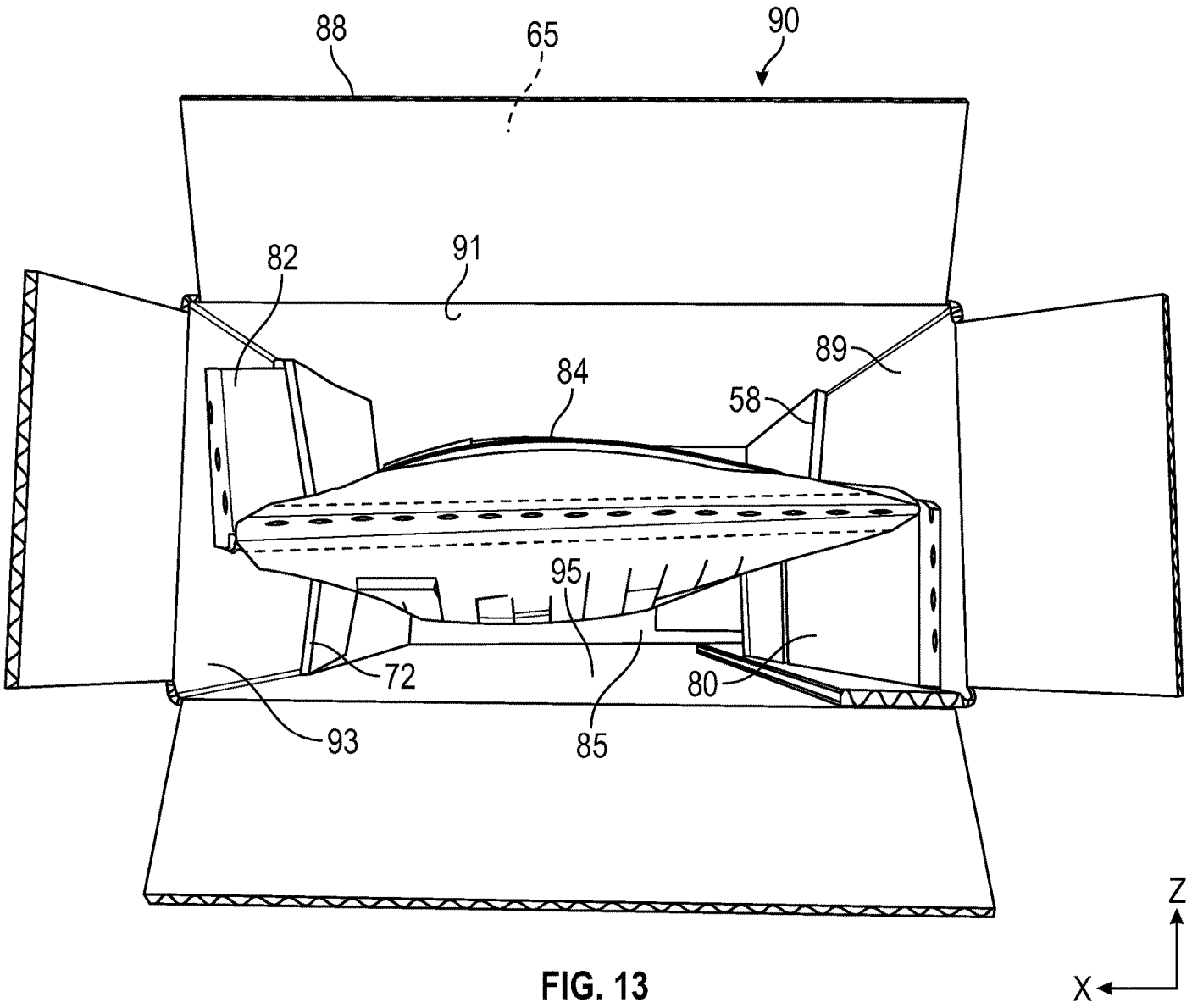
FIG. 13 is an end view of an open end of the box, with the folded insert arranged within the box.

As described further herein, the insert 10 is movable between a relatively planar, first configuration (FIGS. 1-3, 6, and 7) and a folded or functional, second configuration (FIGS. 8, 9, and 11-13). The insert 10 can also be manipulated into an intermediate, expanded configuration (e.g., FIGS. 4, 5, 10, and 16) when positioning a product inside the insert. When the insert 10 is in the first configuration, the panel member 12 is a double-layered panel member 12 (FIG. 1). When the insert 10 is in the intermediate configuration (which can also be referred to as a third configuration), a space or cavity (e.g., cavity 87, as described further below) is formed between the panel layers of the panel member 12 and configured to receive an object (e.g., product). The portion of the insert that defines the cavity 87 is referred to hereinafter as the product-receiving portion 84 of the insert 10 and is described further below. When the insert 10 is in the folded, second configuration, edge portions and extension portions of the insert 10 are pivoted, relative to the product-receiving portion 84, to form support members configured to suspend the product-receiving portion 84 within a container or box into which the insert 10 is inserted. As a result, the product-receiving portion 84 and the object arranged within the cavity 87 can be spaced away from at least a portion of the internal walls (e.g., internal sidewalls) of the container (e.g., as shown in FIG. 13).

Referring to FIGS. 1-5, the panel member 12 can comprise a first fold line 18 (FIGS. 2-5), a second fold line 20 (FIGS. 2, 4, and 5), a third fold line 22 (FIGS. 2-5), and a fourth fold line 24 (FIGS. 3, 4, and 5). The fold lines 18, 20, 22, and 24 can extend parallel to a first axis (e.g., the x-axis of the coordinate axes shown in FIGS. 2 and 3). Accordingly, the insert 10 can be movable between the flat, substantially flat, or planar, first configuration (FIGS. 1-3) and the expanded, intermediate configuration in which the panel member 12 forms a tube with an internal space (e.g., cavity 87). In some embodiments, in the intermediate configuration, the panel member 12 can be expanded into a rectangular tube, as shown in FIGS. 4 and 5.

Figure 6:
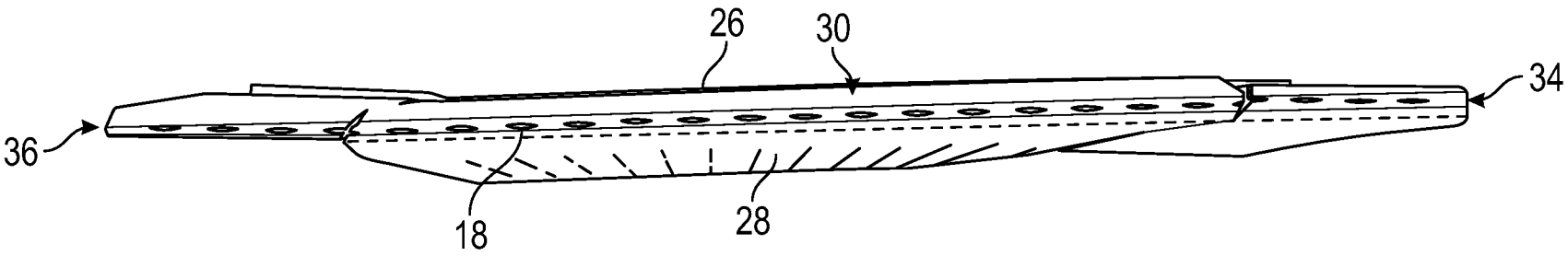
FIG. 6 is a side view of a closed end portion of the insert of FIG. 1.
Figure 7:
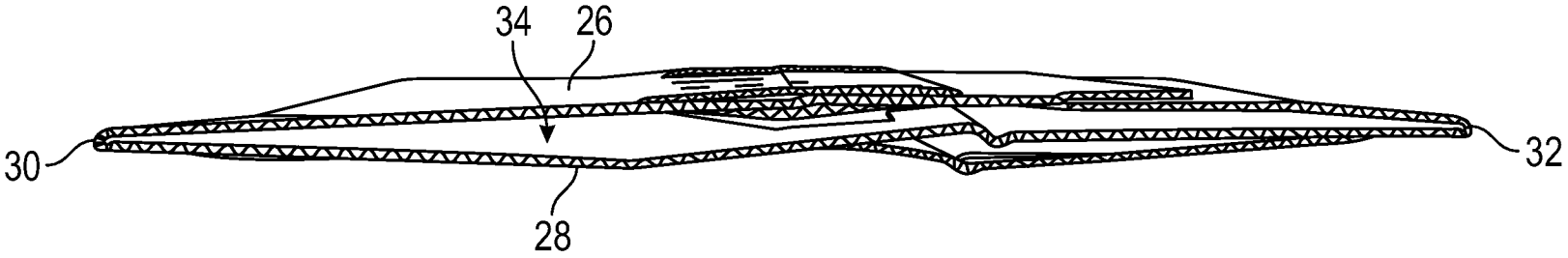
FIG. 7 is a front view of an open end portion of the insert of FIG. 1.

In the planar, first configuration, the panel member 12 is folded about the fold lines 18 and 22 such that the panel member 12 forms a first panel layer or wall 26 (FIG. 2) and an overlapping or coextensive second panel layer 28 (FIG. 3). Thus, the panel member 12 can be referred to herein as a double-layered panel member 12. The relatively flattened insert 10 can also comprise two closed ends and two open ends. For example, in the first configuration, the insert 10 can comprise a first closed end portion 30 corresponding to the fold line 18, a second closed end portion 32 corresponding to the fold line 22, a first open end portion 34 and a second open end portion 36. FIG. 6 is a side elevation view illustrating the closed end portion 30 and FIG. 7 illustrates the open end portion 34.

In certain embodiments, the fold lines 18, 20, 22, and 24 can be creases, perforations, scores, or combinations thereof. For example, in the illustrated embodiment the first fold line 18 and the third fold line 22 can comprise perforations, and the second fold line 20 and the fourth fold line 24 can comprise creases. In other embodiments, the first fold line 18 and the third fold line 22 can comprise creases and the second fold line 20 and the fourth fold line 24 can comprise perforations.

The first panel layer 26 and the second panel layer 28 can also comprise additional fold lines proximate to the first fold line 18 and the third fold line 22 to allow the panel layers to move away from each other in the z-axis (out of the plane of the page in FIG. 2) in order to receive a product between them (e.g., receive a product in a space, volume, or cavity 87 formed between the first panel layer 26 and the second panel layer 28, as described further below with reference to FIGS. 10-12 and 16). For example, referring to FIG. 2, the first panel layer 26 can comprise a perforated fold line 23 proximate to the first fold line 18 and a perforated fold line 25 proximate to the fold line 22. The second panel layer 28 can comprise similar fold lines on the opposite side of the insert, such as a fold line 29 and fold line 31, as shown in FIG. 3.

Referring again to FIGS. 2 and 3, each of the first panel layer 26 and the second panel layer 28 can comprise a plurality of fold lines and cutouts arranged to form foldable or pivotable support members. For example, as shown in FIG. 2, the first panel layer 26 can comprise a fold line 38 proximate to the open end portion 34 and a fold line 40 on the opposite side of the first panel layer 26, proximate to the open end portion 36. The fold lines 38 and 40 can extend parallel to the y-axis. The fold line 38 can define a flap 42 (also referred to herein as a pivotable edge portion or edge portion) pivotable relative to a main body portion 44 of the first panel layer 26, about the fold line 38 (FIG. 2). The fold line 40 can define a flap 46 (also referred to herein as a pivotable edge portion) pivotable relative to the main body portion 44 about the fold line 40.

Beginning at the closed end portion 30 (FIG. 2) and moving in a direction along the positive y-axis, the fold line 38 can comprise a slit portion 48 followed by a perforated portion 50 extending between the slit portion 48 and an opening 52 (which is described in greater detail below). Continuing from the opposite side of the opening 52 in the positive y direction, the fold line 38 can further comprise another perforated portion 54, followed by a cut or slit portion 56 extending to the edge of the second closed end portion 32. In the illustrated embodiment, the fold line 40 can be configured similarly to the fold line 38 (e.g., including the same or similar slit and perforated portions).

In some embodiments, the slit portions 48 and 56 can be configured as cuts or slits through the first panel layer 26 and the perforated portions 50 and 54 can include one or more perforations or cuts that are spaced apart from one another (e.g., not continuous with one another) and extend through an entirety or at least a portion of the first panel layer 26.

As noted above, the first panel layer 26 can define an opening 52 (FIG. 2). The opening 52 can be configured to receive an extension portion (e.g., extension member) 58 coupled to and/or extending from the flap 42 and movable therewith relative to the main body portion 44 into and out of the opening 52. The extension portion 58 can extend inwardly toward the center of the main body portion 44, from the flap 42, along the positive x-axis. In some embodiments, edges of the extension portion 58 can be spaced apart from edges of the opening 52, thereby creating clearance, space, or a gap 33 between the opening 52 and extension portion 58 (FIG. 2).

The first panel layer 26 can further comprise a second opening 60 on the opposite side of the insert from the opening 52 (FIG. 2). The opening 60 can be configured to receive an extension portion configured as a bracing member 62 extending inwardly toward the center of the main body portion 44 from the flap 46, and movable with the flap 46 into and out of the opening 60. In some embodiments, edges of the bracing member 62 can be spaced apart from edges of the opening 60, thereby creating a gap (e.g., spaced or clearance) 35 between the opening 60 and the bracing member 62.

In the illustrated embodiment, a length dimension (length 37 shown in FIG. 2) of the extension portion 58 along the x-axis is greater than the length dimension (length 39 shown in FIG. 2) of the bracing member 62, although in other embodiments they may be the same. The extension portion 58 and bracing member 62 can have the same or similar lengths along the y-axis, as shown in FIG. 2, although in other embodiments these dimensions can also be different. Additionally, although the extension portion 58 and bracing member 62, and the corresponding openings 52 and 60, are illustrated as having rounded corners, in other embodiments the corners may be angled (e.g., right-angled), chamfered, or another shape.

At least the main body portion 44 of the first panel layer 26 can further comprise a plurality of scores or relief cuts referred to herein as slits 64 spaced apart from each other along the x-axis and along the y-axis. The slits 64 can extend parallel to the y-axis and can have the same or different lengths. The slits 64 can be configured to allow the main body portion 44 to flex and expand to a convex shape when a product is received in the insert, as explained in greater detail below.

In some embodiments, the slits 64 can be configured as narrow scores or cuts in the first panel layer 26. In some embodiments, the slits 64 can extend through an entire thickness of the first panel layer 26. In other embodiments, the slits 64 can extend through at least a portion of the thickness of the first panel layer 26.

In embodiments in which the insert 10 comprises a corrugated board material, such as corrugated paperboard, the slits 64 can extend perpendicular to the longitudinal axes (indicated by double-headed arrow 53 shown in FIG. 2) of the corrugations 51 (shown in FIG. 5). For example, as illustrated in FIG. 2 the corrugations 51 can extend along the x-axis, and the slits 64 can extend along they-axis. This can improve the ability of the insert 10 to flex in directions at an angle to the corrugations.

In the illustrated embodiment, the main body portion 44 can also comprise an opening 66 at or near the center of the main body portion 44 (FIGS. 1 and 2). In some embodiments, the opening 66 can be rectangular, although in other embodiments the opening 66 can have any shape, size, and/or location. The opening 66 can allow a user to view the object in the cavity 87 (FIGS. 10,11, and 16) of the product-receiving portion 84 (which can be a pouch/pocket formed by the main body portion 44, as described further below). The opening 66 can also allow a user to manipulate the object within the product-receiving portion 84 to position it at a desired or specified position after the support members have been folded into place. Certain embodiments need not include an opening such as the opening 66, or may include more than one opening 66, depending upon the particular application. Further, in some embodiments, the second panel layer 28 can include additional openings, similar to the opening 66 (FIG. 3).

Turning now to FIG. 3, the second panel layer 28 can be configured similarly to the first panel layer 26. FIG. 3 illustrates the second panel layer 28 as viewed by rotating the insert 10 in FIG. 2 by 180° about the x-axis. The second panel layer 28 can comprise a pivotable edge portion or flap 68 foldable about a fold line 70 from and relative to a main body portion 45 of the second panel layer 28. The second panel 28 can further comprise an extension portion 72 coupled to the flap 68. The extension portion 72 can be configured similarly to the extension portion 58, as described above. The second panel layer 28 can define an opening 79 that is configured to receive the extension portion 72 (e.g., similar to opening 52, as described above).

The second panel layer 28 can further comprise a pivotable edge portion or flap 74 foldable about a fold line 76 from the main body portion 45, and an extension member configured as a bracing member 78 extending from the flap 74 (FIG. 3). The bracing member 78 can be configured similar to the bracing member 62 of the first panel layer 26. The second panel layer 28 can define an opening 61 that is configured to receive the bracing member 78 (e.g., similar to opening 60, as described above).

In some embodiments, the fold line 70 and the fold line 76 can be configured similar to the fold line 38 and the fold line 40, respectively. For example, each of the fold line 70 and the fold line 76 can comprise a first slit portion 71, a first perforated portion 73, a second perforated portion 75, and a second slit portion 77 (FIG. 3).

In the illustrated embodiment, when looking at the first panel layer 26 (FIG. 2) the bracing member 78 of the second panel layer 28 can be positioned beneath the extension portion 58 of the first panel layer 26 and the extension portion 72 of the second panel layer 28 can be positioned beneath the bracing member 62 of the first panel layer 26.

Additionally, similar to the first panel layer 26, the second panel layer 28 can include a plurality of slits 64 in the main body portion 45 of the second panel layer 28. The slits 64 in the second panel layer 28 can be configured the same or similar to the slits 64 in the first panel layer 26.

Each of the extension portion 58, bracing member 62, extension portion 72, and bracing member 78 (which can all be referred to herein as extension portions) can have a free end 19 and an attached end 21 (FIGS. 2, 3, and 8), where the attached end 21 is coupled to or continuous with the respective flap (e.g., edge portion) 42, 46, 68, and 74, and the free end 19 is configured to move freely within the respective opening 52, 60, 79, and 61.

Figure 8:
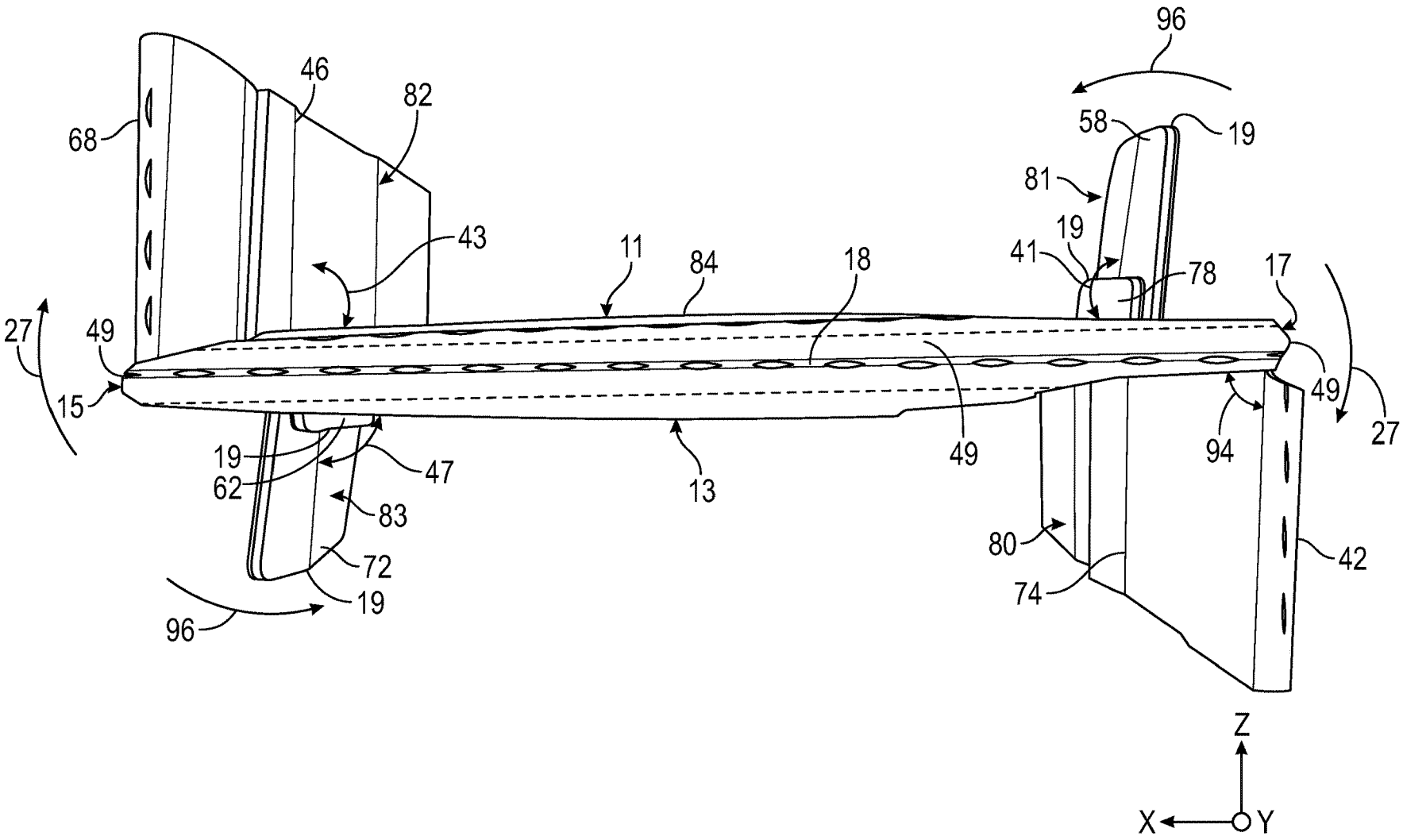
FIG. 8 is a side view of the insert of FIG. 1 in the folded configuration.
Figure 9:
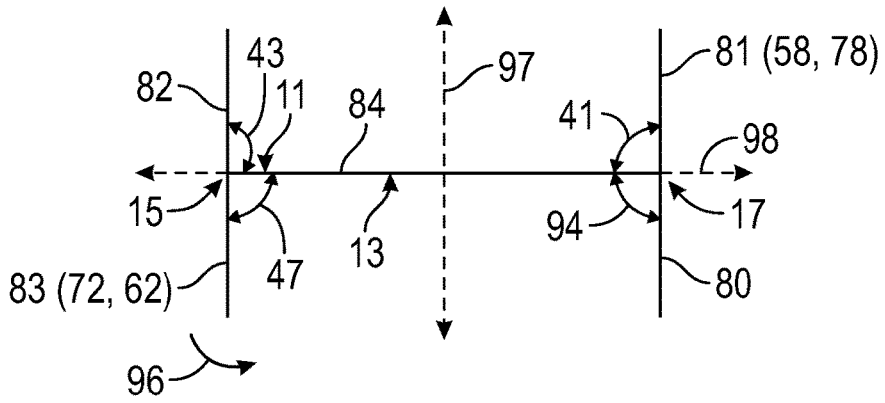
FIG. 9 is a schematic view illustrating an H-shaped profile formed by support members and a product-receiving portion of the insert in the folded configuration of FIG. 8.

Referring to FIGS. 1, 8, and 9, and as introduced above, the insert 10 can be movable or foldable between the flat, planar, or collapsed, first configuration (FIG. 1) and a folded or functional, second configuration (FIG. 8). In the second configuration, the panel member 12 (e.g., the first and second panel layers 26 and 28) can also define a main body portion configured as a pouch that defines the product-receiving portion 84 (FIG. 8). For example, the main body portion 44 of the first panel layer 26 and the main body portion 45 of the second panel layer 28, together, can form the product-receiving portion 84. The product-receiving portion 84 can have a first side 11 and second side 13 (which can also be referred to as surfaces) that are arranged opposite one another across a horizontal axis 98 of the product-receiving portion 84 (FIG. 9), and a first end 15 and a second end 17 that are arranged opposite one another across a central longitudinal axis 97 of the product-receiving portion 84 (FIG. 9).

Further, in the functional configuration, the panel member 12 can further define two or more support members configured to support the insert 10 when arranged within a container or box (e.g., as shown in FIG. 13, as described in greater detail below) and suspend the product-receiving portion 84 within the container and away from two or more interior side walls of the container. In some embodiments, as described above, in the functional configuration, the insert can include four support members. However, in other embodiments, the insert 10 can include another number of support members, such as two or three support members.

More particularly, with reference to FIGS. 8 and 9, in some embodiments, the flaps 42 and 74 can be moved, folded, pivoted, or erected along the respective fold lines 38 and 76 (FIGS. 2 and 3) in the direction of arrow 27 (FIG. 8) to form a double-layered first support member 80. As used herein, a "layer" can be a sheet of material (e.g., paper), and/or a composite material construction (e.g., corrugated paperboard or fiberboard) that is movable/pivotable as a unitary body. Thus, in the illustrated example the flap 42 is a first layer of the double-layered first support member 80 and the flap 74 is a second layer of the double-layered first support member 80. In certain embodiments, the first support member 80 can extend at an angle 94 (e.g., in a range of 60° to 100°, in a range of 80° to 100°, perpendicular or 90°, or substantially perpendicular or 90°±5°) relative to a horizontal plane (e.g., the x-y plane in FIG. 8) defined by the product-receiving portion 84 (FIGS. 8 and 9). In the configuration illustrated in FIG. 8, the first support member 80 is oriented downwardly along the negative z-axis. Moving, folding, or pivoting the flaps 42 and 74 can cause the extension portions 58 and 78 to pivot upwardly simultaneously such that they extend above the product-receiving portion 84 in the y-z plane and form a second support member 81. In some embodiments, as shown in FIGS. 8 and 9, the second support member 81 can extend outward, at an angle 41 (e.g., in a range of 60° to 100°, in a range of 80° to 100°, perpendicular or 90°, or substantially perpendicular or 90°±5°) from the product-receiving portion 84. In some embodiments, the angle 41 can be the same as the angle 94. In other embodiments, the angle 41 and angle 94 can be different.

In the illustrated embodiment, the extension portion 58 extends further in the z-direction than (e.g., past) the bracing member 78, although other configurations are possible. Said another way, the extension portion 58 can extend a greater distance beyond (in the z-direction) the bracing member 78. In certain embodiments, the bracing member 78 can extend beyond the location where the extension portion 58 is coupled to the flap 42 in order to support or brace the extension portion 58 against counterclockwise rotation (e.g., in a direction shown by arrow 96 in FIG. 8) or buckling about they-axis. In this way, the first support member 80 and the second support member 81 are arranged on the same, second end 17 and on opposite sides (e.g., first side 11 and second side 13) of the product-receiving portion 84. For example, the first support member 80 and the second support member 81 can extend outward, in different directions (e.g., along the z-axis), from the opposite first and second sides 11 and 13 of the product-receiving portion 84.

Still referring to FIG. 8, the flaps 46 and 68 can also be movable, foldable, or pivotable along the respective fold lines 40 and 70 (FIGS. 2 and 3) to form a double-layered third support member 82 on the opposite end (e.g., the first end 15) of the product-receiving portion 84 from the first support member 80 (which is located at the second end 17). The third support member 82 can extend outward (e.g., upwardly in FIG. 8) from the product-receiving portion 84 in the y-z plane (e.g., a plane of the third support member 82 is in the y-z plane), and can form an angle 43 with the product-receiving portion 84 (e.g., in a range of 60° to 100°, in a range of 80° to 100°, perpendicular or 90°, or substantially perpendicular or 90°±5°). In some embodiments, the angle 43 can be the same or similar to the angle 94. In other embodiments, the angle 43 can be different from the angle 94.

For example, the third support member 82 and the first support member 80 can be arranged on opposite sides of the product-receiving portion 84 relative to the horizontal axis 98, and opposite ends of the product-receiving portion 84 relative to the central longitudinal axis 97 of the product-receiving portion 84 (FIG. 9).

The extension portion 72 and the bracing member 62 can simultaneously pivot downwardly such that they extend generally along the z-axis below the product-receiving portion 84 to form a fourth support member 83 (FIGS. 8 and 9). The bracing member 62 can support or brace the extension portion 72 to reduce the tendency of the extension portion 72 to rotate or buckle in the counterclockwise direction about the y-axis, as shown by arrow 96 (FIGS. 8 and 9). In some embodiments, as shown in FIGS. 8 and 9, the fourth support member 83 can extend outward, at an angle 47 (e.g., in a range of 60° to 100°, in a range of 80° to 100°, perpendicular or 90°, or substantially perpendicular or 90°±5°) from the product-receiving portion 84. In some embodiments, the angle 47 can be the same as the angle 43. In other embodiments, the angle 47 and angle 43 can be different.

In this way, the third support member 82 and the fourth support member 83 are arranged on the same, first end 15 and on opposite sides (e.g., first side 11 and second side 13) of the product-receiving portion 84. For example, the third support member 82 and the fourth support member 83 can extend outward, in different directions (e.g., along the z-axis), from the opposite first and second sides 11 and 13 of the product-receiving portion 84.

When the support members 80-83 are erected or folded into position, the insert 10 can be in the functional, second configuration and have an H-shaped profile when viewed edge-on from the closed end portions 30 and 32. FIG. 9 schematically illustrates the H-shaped profile formed by, from top to bottom and left to right, the third support member 82, the fourth support member 83 (and/or the extension portion 72), the product-receiving portion 84, the second support member 81 (and/or the extension portion 58), and the first support member 80. When the first and third support members 80 and 82 are erected and the insert 10 is in the functional, second configuration, the product-receiving portion 84 can also be closed on all four edges 49 by the closed end portions 18 and 22, and by the walls of the flaps 42 and 68 (FIG. 8).

Figure 10:
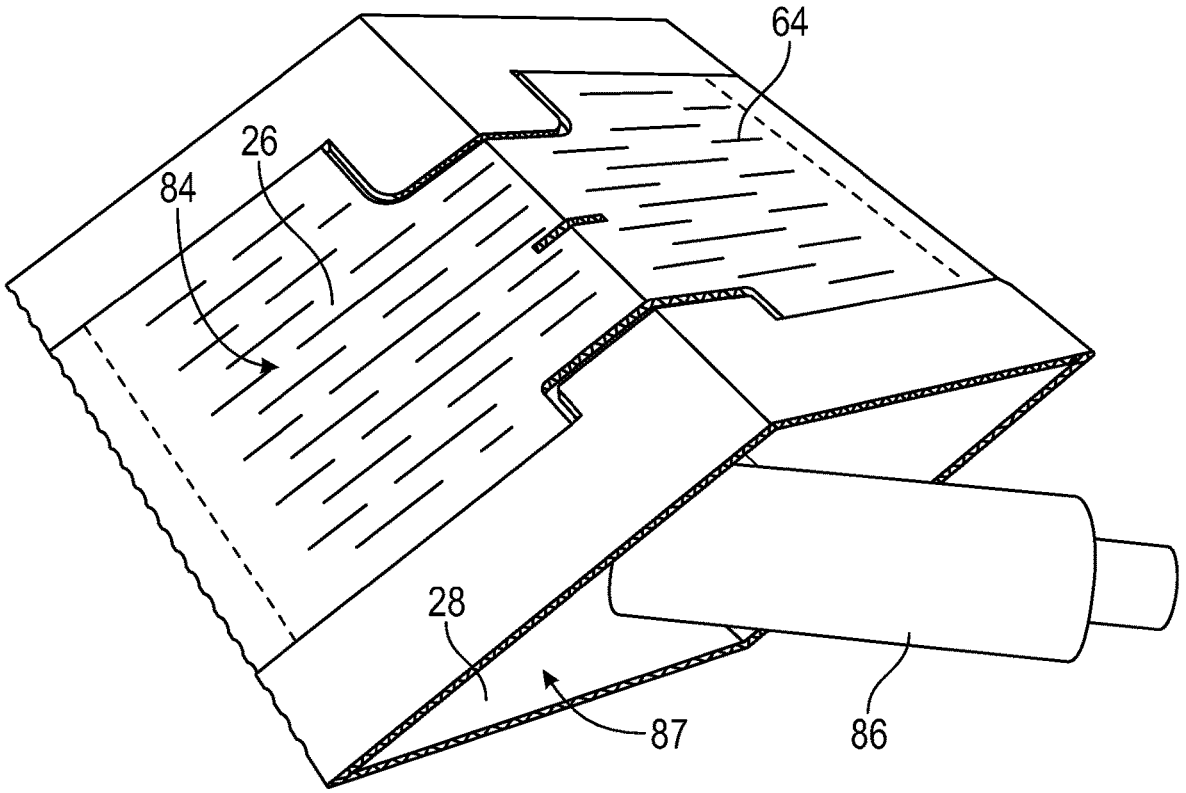
FIG. 10 illustrates placing an object in the product-receiving portion of the insert.

With reference to FIG. 10, in use and when the insert 10 is in the intermediate configuration, a product (e.g., object) 86 can be inserted into the cavity (e.g., space) 87 defined by the product-receiving portion 84 between the first and second panel layers 26 and 28 through, for example, the flaps 42 and 74 (FIGS. 2 and 3) of the open end portion 34 (FIG. 7) or the flaps 46 and 68 of the open end portion 36. The panel member 12 can be at least partially opened by folding the panel member about the fold lines 18, 20, 22, and 24 (FIGS. 4 and 5) into a parallelogram or rectangular shape.

Figure 16:
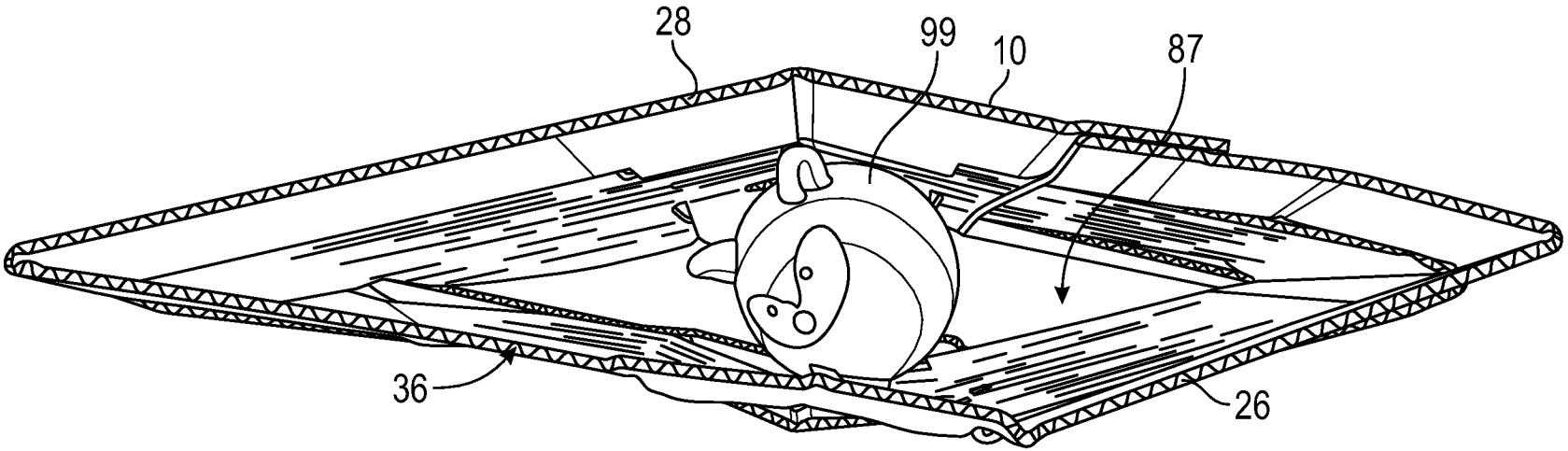
FIG. 16 is a front view of the insert of FIG. 1 in the expanded configuration, with an object arranged within a product-receiving portion of the insert.

FIG. 16 is an open end-view (e.g., from open end portion 36) of the insert 10 with another product 99 arranged within a central portion of the cavity 87 and wedged between the first panel layer 26 and the second panel layer 28. Thus, as discussed further below and shown in FIGS. 10 and 16, products of different sizes and shapes can be received in the cavity 87 of the product-receiving portion 84 of the same insert 10.

Referring to FIG. 11, after arranging the product 86 inside the cavity 87, the insert 10 can be folded into the functional, second configuration and the support members 80-83 can be erected by folding or pivoting the flaps or edge portions 42 and 74 in a first direction (e.g., downwardly in FIG. 11) and folding the flaps or edge portions 46 and 68 in an opposite, second direction (e.g., upwardly in FIG. 11). The first and second panel layers 26 and 28 can expand, curve, or flex to conform to the shape and size of the product 86 aided by the slits 64 (e.g., by forming a convex surface 67).

Referring to FIG. 12, the folded insert 10, in the second configuration, can then be disposed or inserted into a container or box 88 comprising internal height, width, and length dimensions configured to accommodate the insert 10 in the second, functional configuration shown in FIGS. 8 and 12. In the illustrated embodiment, the container 88 comprises an open end 90 and a closed end 92. The insert 10 can also be dimensioned to fit into particular containers.

FIG. 13 illustrates the shipping insert 10 received inside the container 88, from the open end 90 of the container 88. When closed, the container 88 can comprise six interior walls, including side walls 89, 91, 93, and 95, and end walls 85 (at the closed end 92) and 65 (formed when the flaps at the open end 90 of the box are closed). Surfaces, edges, and/or projections or extensions of the insert 10 can brace the insert 10 against the interior surfaces of the walls of the container 88 such that the product-receiving portion 84 is suspended in the x-z plane away from or spaced apart from at least the side walls 89, 91, 93, and 95 of the container 88. In some embodiments, at least a portion of the support members 80-83 are configured to contact one or more of the sides walls 89, 91, 93, and 95.

For example, the first support member 80 and the extension portion 72 (e.g., the support member 83) can contact the wall 95, and the third support member 82 and the extension portion 58 (e.g., the support member 81) can contact the side wall 91 such that the product-receiving portion 84 is spaced apart from (and not in direct contact with) each of the side walls 91 and 95. The product-receiving portion 84 can also be spaced apart from the side wall 89 by at least the combined thickness of the flaps 42 and 74 (FIG. 8) of the first support member 80, and spaced apart from the side wall 93 by the combined thickness of the flaps 46 and 68 of the third support member 82. The closed end portions 30 and 32 of the insert 10 can contact the end walls 85, and 87 of the container 88 when the container 88 is closed.

As shown in FIG. 13, the first and second panel layers 26 and 28 of the insert 10 can deform, flex, or bulge into a convex shape (e.g., to form the convex surface 67) to conform to the shape of the product received in the product-receiving portion 84.

Figure 14:
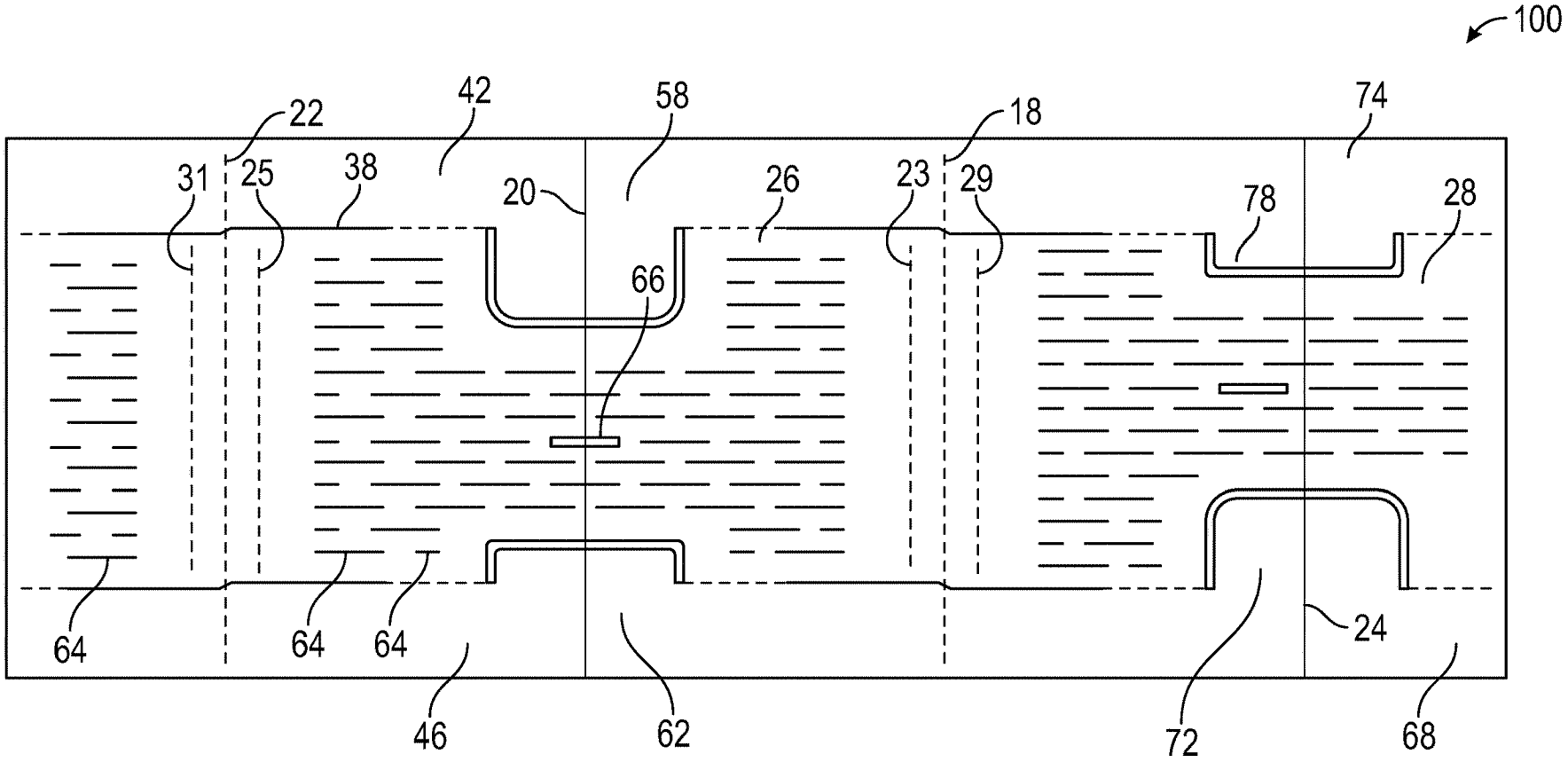
FIG. 14 is a top plan view of a blank from which the insert of FIGS. 1-9 can be made, according to one embodiment.

In certain embodiments, the insert 10 can be constructed, folded, or assembled from a single piece of material, such as corrugated paperboard having one or more face sheets with a corrugated or fluted layer therebetween. FIG. 14 shows a representative example of a corrugated paperboard blank 100 from which the insert 10 can be assembled. The blank 100 can comprise a one-piece, unitary construction wherein each of the walls, extension portions, tabs, fold lines, knife cuts, score lines, and/or perforations, etc., are integrally formed with the blank. For example, FIG. 14 shows the first panel layer 26 and the second panel layer 28, which can be continuous with one another, and their various extension portions, fold lines, slits, openings, and the like, as previously described above with reference to FIGS. 1-13.

As used herein, the terms "unitary construction" and "integrally formed" refer to a construction that does not include any welds, fasteners, or other means for securing separately formed pieces of material to each other. In other embodiments, any of the various panels, extension portions, tabs, etc., can be separately formed and secured to the main body of the insert. In certain embodiments, the cuts, fold lines, score lines, etc., of the blank 100 can be formed in an in-line, streamlined manufacturing process such that the blank can be produced without requiring that the production equipment be stopped.

The insert embodiments described herein can also be made from any of various cellulosic fiber-based materials/cellulose-based sheet materials, such as paperboard, linerboard, kraft paper, solid or fluted sheet materials, multi-ply or single ply sheet materials, and the like. The insert embodiments can also comprise any of various non-cellulosic materials, such as polymeric or petroleum-based sheet materials including plastic sheets, films, walls, and/or layers. Such non-cellulosic materials may comprise structural and/or non-structural elements of the insert. The inserts can also comprise metal foils, metalized films, metal or plastic screening, rigid or semi-rigid webbing, or any other flexible or pliable sheet material. The inserts can also comprise any combination of the materials recited herein.

The insert embodiments described herein can also include one more surface treatments/coatings/films (e.g., such as on surfaces which may contact the object/goods contained in the insert). Such treatments may include anti-abrasion coatings, water resistance coatings, grease/oil-resistant coatings, vapor/odor-trapping coatings, release/non-stick/friction-reducing coatings (e.g., polytetrafluoroethylene), friction-enhancing/slip-resistant coatings, electrostatic discharge (ESD) coatings, flame or fire-resistant coatings, any of various dyes or colorants, and any combination thereof. Any of these materials may also be incorporated into the cellulosic or polymer-based materials forming the structure of the insert (e.g., into the pulp from which the cellulosic fiber-based sheet material is made).

Figure 15:
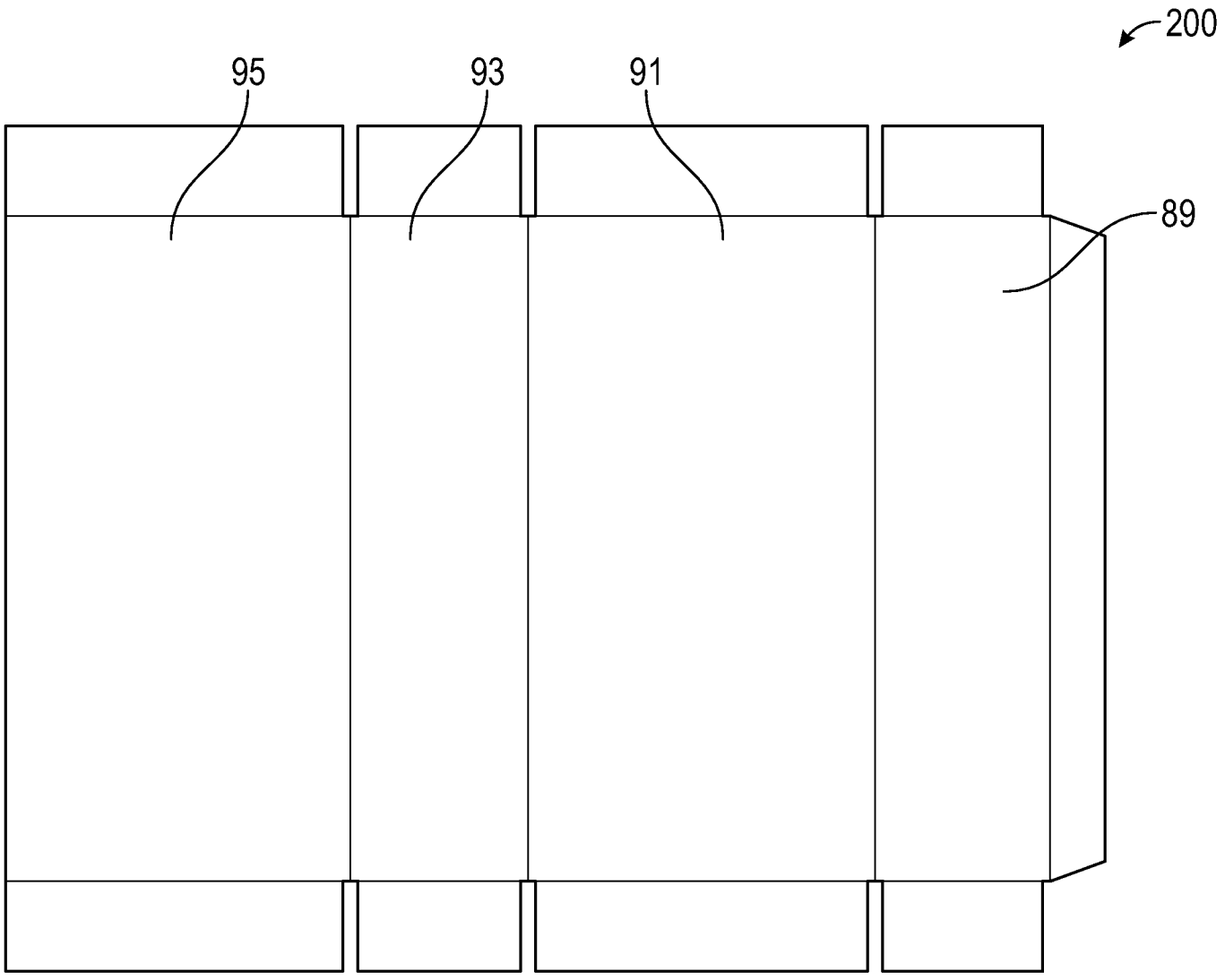
FIG. 15 is a top plan view of a blank from which a box configured to receive the insert of FIGS. 1-9 can be made.

FIG. 15 illustrates a representative embodiment of a blank 200 from which the container 88 of FIG. 12 can be constructed.

One or more of the embodiments of the present disclosure can provide significant advantages over known packaging configurations. For example, because the support members and/or extension portions of the insert 10 contact the side walls 89, 91, 93, and 95 of the container 88, and the closed end portions 30 and 32 of the insert 10 contact the end walls 85 and 65, a product disposed at or near the center of the product-receiving portion 84 can be spaced apart from all six walls of the container 88 (e.g., spaced inwardly from the walls of the container along three axes), or suspended at or near the volumetric center of the container. Additionally, the space or volume defined between the first and second panel layers 26 and 28 (e.g., the cavity 87) can taper or narrow toward the edges of the product-receiving portion 84. Accordingly, although products may be free to move slightly near the center of the product-receiving portion 84, they will become wedged between the first and second panel layers 26 and 28 at the corners and/or edges of the product-receiving portion 84, thereby limiting further movement and preventing contact with the walls of the container 88. The first and third support members 80 and 82, along with the extension portions 58 and 72, can also prevent rotation of the insert 10 inside the container 88 about any axis. Thus, a product received in the insert 10 can be protected from impacts, and from displacement toward the walls of the box, thereby also preventing potential damage from inward (e.g., compression) forces against walls of the container 88. Additionally, because certain embodiments of the insert 10 are plastic-free, or substantially plastic-free, the insert 10 and the container 88 are recyclable, unlike existing packaging systems including gas bladders, plastic film, and other polymer-based cushioning or restraints.

One or more of the insert embodiments described herein can also provide significantly improved consumer usability. For example, once a product is inserted into the product-receiving portion 84, the first and second support members 80 and 81 can be simultaneously erected by folding the flaps 42 and 74 into place, and the third and fourth support members 82 and 83 can be simultaneously erected by folding the flaps 46 and 68 into place. Thus, with only two folding actions, the insert 10 can provide stability and impact resistance in six directions, along all three axes.

The ability of the product-receiving portion 84 to conform to the shape of the product also allows a wide variety of products to be accommodated, including all manner of shapes, sizes, and weights (e.g., as shown in FIGS. 10 and 16). For example, the product-receiving portion 84 can accommodate relatively flat, rectangular objects, as well as round or cylindrical objects having any aspect ratio and dimensions which fit within the product-receiving portion. Additionally, because movement of a product in any direction will cause it to eventually become wedged between the first and second panel layers 26 and 28 at the edges and/or corners of the product-receiving portion, the insert 10 can accommodate relatively heavy products (e.g., liquid-filled containers, glass or metal objects, etc.) which traditionally require significant quantities of plastic material to adequately cushion and restrain.

Certain embodiments of the insert disclosed herein are formed substantially (99% or greater) of biodegradable materials. Certain embodiments of the insert disclosed herein are formed completely from biodegradable materials. Certain embodiments are plastic-free, or substantially plastic-free (i.e., less than 1% plastic). Certain embodiments of the insert are free of or substantially free of polyethylene (PE) and/or other synthetic polymers, which materials are typically found in conventional inserts in the form of liners, membranes, walls, shock-absorbing means such as gas bladders, etc. For example, in certain embodiments at least 90%, 92%, 95%, 97%, 98%, or more of the total mass of the insert is biodegradable. As used herein, "biodegradable" means that the referenced article can be substantially (at least 95%) or completely decomposed by microorganisms (e.g., bacteria, fungi, etc.) or other natural processes in one year or less from the time the article is placed in the trash, a landfill or the like. Certain of the disclosed inserts can also be produced using certain percentages by weight of renewable plant-based fiber materials and/or recycled materials. As used herein, cellulosic or paper material, especially such material treated with water-resistant coatings or additives, is "recyclable" if it can be processed into new paper/paperboard/cardboard/corrugated or other plant-based fiber material using the process defined in the Fibre Box Association's Voluntary Standard for Repulping and Recycling Corrugated Fiberboard Treated to Improve its Performance in the Presence of Water and Water Vapor. The containers or boxes into which the inserts are placed can also be biodegradable and/or recyclable, and can comprise cellulosic fiber-based materials.

In alternate embodiments, instead of having four support members that result in the insert having an H-shaped profile when in the folded or functional configuration and viewed edge-on from the closed end portions 30 and 32 (e.g., as shown in FIG. 9), the insert can have less then four support members resulting in a differently-shaped profile. For example, the insert may include two support members disposed at one end of the product-receiving portion, resulting in a T-shaped profile. In other examples, the insert can include a different number of support members, such as three support members.

Explanation of Terms

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

As used herein, the terms "box" and "container" refer to an article that is capable of holding one or more products or other physical articles. As used herein, the term "cardboard box" refers to a box formed from any of a variety of heavy paper-like materials (e.g., cellulosic fiber-based materials), including, for example, cardstock, corrugated fiberboard, and/or paperboard. As used herein, the term "corrugated paperboard" refers to a fluted corrugated medium with one or more flat liner layers coupled thereto, such as a central corrugated layer with a first liner layer on one side and a second liner layer on another side of the central corrugated layer.

As used herein, the term "blank" refers to a flat sheet of material that is formed into an article (such as an insert) or a container, such as a flat sheet of corrugated paperboard. As used herein, the term "flat-formed" refers to an article that is manufactured from one or more flat pieces, such as a blank, that is manipulated into a different shape, such as by folding. As used herein, the terms "hingedly coupled" and/or "pivotably coupled" refers to any manner of engagement between a first part of a blank relative to a second part of the blank which allows the first part to travel relative to the second part without the first part becoming disengaged from the second part, such as by one or more fold lines, one or more cut lines, and/or some combination thereof. As used herein, the term "cut line" refers to an area that includes a cut that extends at least partially through the blank to facilitate folding, tearing, and/or some other structural advantage. Cut lines can be straight, curved, or some other shape, and can include perforation lines in which the cut is not continuous along the length of the cut line (i.e., a perforated line is a cut line that is discontinuous).

Unless otherwise indicated, all numbers expressing angles, dimensions, quantities of components, forces, moments, molecular weights, percentages, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited. Furthermore, not all alternatives recited herein are equivalents.

Although there are alternatives for various components, parameters, operating conditions, etc., set forth herein, that does not mean that those alternatives are necessarily equivalent and/or perform equally well. Nor does it mean that the alternatives are listed in a preferred order unless stated otherwise.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. We therefore claim all that comes within the scope and spirit of these claims.

I claim:

1. An article, comprising:

a panel member folded to form a collapsible sleeve comprising a first panel layer and a second panel layer, the panel member being movable between a planar, first configuration and a folded, second configuration, the first and second panel layers defining a product-receiving portion;

wherein the first panel layer comprises a pivotable edge portion and an extension portion coupled to the pivotable edge portion and received in an opening defined in the first panel layer;

wherein the second panel layer comprises a pivotable edge portion and an extension portion coupled to the pivotable edge portion and received in an opening defined in the second panel layer;

wherein the pivotable edge portion of the first panel layer and the pivotable edge portion of the second panel layer are pivotable together to form a double-layered support member extending outward, at an angle to the product-receiving portion from a first side of the product-receiving portion; and wherein the extension portions are pivotable out of their respective openings to extend outward from an opposite, second side of the product-receiving portion by motion of the pivotable edge portions.

2. The article of claim 1, wherein:

the pivotable edge portions of the first panel layer and the second panel layer are first pivotable edge portions;

the extension portions of the first panel layer and the second panel layer are first extension portions; and each of the first and second panel layers comprises a second pivotable edge portion and a second extension portion on the opposite side of the product-receiving portion from respective first pivotable edge portions.

3. The article of claim 2, wherein:

the panel member is a rectangular panel member comprising two open ends and two closed ends;

the first pivotable edge portions of the first and second panel layers are located at a first open end of the two open ends; and the second pivotable edge portions of the first and second panel layers are located at a second open end of the two open ends.

4. The article of claim 3, wherein, when the panel member is in the second configuration and the first and second pivotable edge portions are pivoted relative to the product-receiving portion, the two open ends of the panel member are closed such that a volume within the product-receiving portion is enclosed.

5. The article of claim 1, wherein the extension portion of the first panel layer extends a greater distance beyond the product-receiving portion than the extension portion of the second panel layer when the extension portions are pivoted out of their openings and the panel member is in the second configuration.

6. The article of claim 1, wherein edges of the panel member are secured together to form the collapsible sleeve.

7. The article of claim 1, wherein the first panel layer and the second panel layer comprise slits such that the first and second panel layers can expand to a convex shape when an object is received between the first and second panel layers, in the product-receiving portion.

8. The article of claim 1, wherein the article comprises a cellulosic fiber-based material.

9. The article of claim 1, wherein the article is plastic-free.

10. The article of claim 1, wherein the angle is between 60 and 100 degrees.

11. A system, comprising:

a box including a plurality of internal walls; and an article configured to be moved from a planar, first configuration, to a folded, second configuration and arranged within the box in the second configuration such that a product-receiving portion of the article is suspended within and spaced away from at least a portion of the plurality of internal walls, wherein the article comprises:

the product-receiving portion formed by main body portions of a first panel layer and a second panel layer of the article; and a plurality of support members formed by pivotable edge portions and extension portions of the first panel layer and the second panel layer, the plurality of support members extending outward from the product-receiving portion, wherein at least a portion of the plurality of support members are configured to contact one or more of the internal walls of the box, wherein support members of the plurality of support members extend outward from opposite sides of the product-receiving portion relative to a horizontal plane defined by the product-receiving portion, and from opposite ends of the product-receiving portion relative to a central longitudinal axis of the product-receiving portion, and wherein the plurality of support members includes:

a first support member that is formed by first pivotable edge portions of the first and second panel layers disposed on a first end of the product-receiving portion; and a second support member that is formed by first extension portions of the first panel layer and the second panel layer that extend from respective first pivotable edge portions of the first and second panel layers, wherein the first support member and the second support member are disposed on the first end of the product-receiving portion and extend outward, in different directions, from the opposite sides of the product-receiving portion when the article is in the second configuration.

12. The system of claim 11, wherein support members of the plurality of support members extend outward, at an angle, from the product-receiving portion and wherein the angle is between 60 and 100 degrees.

13. The system of claim 11, wherein the plurality of support members includes:

a third support member that is formed by second pivotable edge portions of the first and second panel layers disposed on a second end of the product-receiving portion, the second end disposed opposite the first end, relative to the central longitudinal axis; and a fourth support member that is formed by second extension portions of the first panel layer and the second panel layer that extend from respective second pivotable edge portions of the first and second panel layers, wherein the third support member and the fourth support member are disposed on the second end of the product-receiving portion and extend outward, in different directions, from the opposite sides of the product-receiving portion when the article is in the second configuration.

14. The system of claim 13, wherein the first support member and the fourth support member extend outward from a first side of the opposite sides of the product-receiving portion and the second support member and the third support member extend outward from a second side of the opposite sides of the product-receiving portion.

15. The system of claim 11, wherein the product-receiving portion comprises a cavity defined between the first panel layer and the second panel layer, the cavity configured to receive a product therein.

16. The system of claim 15, wherein the main body portions of the first panel layer and the second panel layer comprise a plurality of slits configured to allow the main body portions to expand to a convex shape when the product is received within the cavity.

17. An article, comprising:

a double-layered panel member comprising a first panel layer and a second panel layer, the panel member being movable between a planar, first configuration and a folded, second configuration, the first and second panel layers defining a product-receiving portion;

wherein the first and second panel layers comprise pivotable edge portions and extension portions coupled to the pivotable edge portions, the extension portions having free ends, the extension portions extending inwardly toward a center of main body portions of the first and second panel layers from the pivotable edge portions when the panel member is in the first configuration; and wherein the pivotable edge portions and the extension portions of the first and second panel layers are pivotable to form support members extending from opposite, first and second sides of the product-receiving portion when the panel member is in the second configuration.

18. The article of claim 17, wherein:

the double-layered panel member comprises corrugated board comprising corrugations extending in a first direction; and the first panel layer and the second panel layer comprise a plurality of slits extending in a second direction that is perpendicular to the first direction such that the first panel layer and the second panel layer can flex to accommodate an object in the product-receiving portion.

19. The article of claim 17, wherein the first and second panel layers form a cavity of the product-receiving portion that is configured to receive an object, the cavity defined by a space between the first and second panel layers.

20. A system, comprising:

the article of claim 1; and a box including a plurality of internal walls, wherein the double-layered support member and the extension portions of the article are configured to contact internal walls of the box when the article is inserted into the box in the folded, second configuration.

21. A system, comprising:

the article of claim 17; and a box including a plurality of internal walls, wherein the support members of the article are configured to contact internal walls of the box when the article is inserted into the box in the folded, second configuration.

* * * * *